US007163113B2

(12) United States Patent
Manganiello et al.

(10) Patent No.: US 7,163,113 B2
(45) Date of Patent: Jan. 16, 2007

(54) VENT DISC WITH CENTER KNOB

(75) Inventors: Francis X. Manganiello, Pompton Plains, NJ (US); Charles John Renz, Briarcliff Manor, NY (US); Joshua S. Lieberman, Pompton Lakes, NJ (US)

(73) Assignee: Playtex Products, Inc., Westport, CT (US)

( * ) Notice: Subject to any disclaimer, the term of this patent is extended or adjusted under 35 U.S.C. 154(b) by 0 days.

(21) Appl. No.: 09/906,320

(22) Filed: Jul. 16, 2001

(65) Prior Publication Data

US 2002/0050481 A1 May 2, 2002

(51) Int. Cl.
*A61J 9/04* (2006.01)
*B65D 51/16* (2006.01)
*A61J 11/02* (2006.01)

(52) U.S. Cl. ..... 215/11.5; 215/260; 215/262; 215/310; 220/203.17; 220/203.18

(58) Field of Classification Search ..... 215/310, 215/11.4, 11.5, 260, 305, 307, 902, 262, 261, 215/276; 220/752, 367.1, 203.18, 203.15, 220/203.16, 203.17
See application file for complete search history.

(56) References Cited

U.S. PATENT DOCUMENTS

| | | | | |
|---|---|---|---|---|
| 357,439 | A | 2/1887 | Wheelock | |
| 577,199 | A | 2/1897 | Neidleinger | |
| 921,387 | A | 5/1909 | Etter | |
| 1,972,895 | A | 9/1934 | Maccoy | |
| 2,060,212 | A | 11/1936 | Herstein | |
| 2,084,099 | A | 6/1937 | Maccoy | |
| 2,365,947 | A | 12/1944 | Ganson | |
| 2,525,745 | A | 10/1950 | Wycoff | |
| 2,546,681 | A | 3/1951 | Searer | |
| 2,582,489 | A * | 1/1952 | Krueger | 215/262 |
| 2,774,500 | A | 12/1956 | Budiani | |
| 2,960,088 | A | 11/1960 | Witz | |
| 2,982,432 | A | 5/1961 | Mehl | |
| 3,113,687 | A | 12/1963 | Butts | |
| 3,134,495 | A | 5/1964 | Carbonel | |
| 3,247,630 | A | 4/1966 | Ponder | |
| 3,511,407 | A | 5/1970 | Palma | |
| 3,718,140 | A | 2/1973 | Yamauchi | |
| 3,768,682 | A | 10/1973 | Meyers et al. | |
| 3,883,025 | A | 5/1975 | Jemmett | |
| 4,010,861 | A | 3/1977 | Welten | |
| 4,215,785 | A | 8/1980 | Schwaiger | |
| 4,311,245 | A | 1/1982 | Maffei | |

(Continued)

FOREIGN PATENT DOCUMENTS

| | | |
|---|---|---|
| FR | 1058610 | 3/1954 |

(Continued)

*Primary Examiner*—Nathan J. Newhouse
*Assistant Examiner*—Niki M. Eloshway
(74) *Attorney, Agent, or Firm*—Ohlandt, Greeley, Ruggiero & Perle, L.L.P.

(57) ABSTRACT

A member that positions a vent disc in an end of a container is provided. The member has at least one projection extending from the vent disc virtually solely for positioning the vent disc in its secured position in the end of a container. The at least one projection is located in the center portion of the vent disc and can be one projection, which extends from the vent disc at the center point of the vent disc. The projection can be of a geometrical shape that facilitates gripping and the handling of the vent disc, including rectangular, ellipsoidal or cylindrical shapes.

32 Claims, 4 Drawing Sheets

U.S. PATENT DOCUMENTS

| | | | | | |
|---|---|---|---|---|---|
| 4,401,224 | A | | 8/1983 | Alonso | |
| 4,545,491 | A | | 10/1985 | Bisgaard et al. | |
| 4,685,577 | A | | 8/1987 | Chen | |
| 4,723,668 | A | | 2/1988 | Cheng | |
| 4,818,114 | A | | 4/1989 | Ghavi | |
| 4,865,207 | A | | 9/1989 | Joyner et al. | |
| 4,928,836 | A | | 5/1990 | Wu et al. | |
| 4,940,151 | A | | 7/1990 | Fett | |
| 4,964,659 | A | * | 10/1990 | Baldwin | 220/235 |
| 4,993,568 | A | | 2/1991 | Morifuji et al. | |
| 5,071,017 | A | | 12/1991 | Stull | |
| 5,078,287 | A | | 1/1992 | Holmes, III | |
| 5,101,991 | A | | 4/1992 | Morifuji et al. | |
| 5,215,312 | A | | 6/1993 | Knappe et al. | |
| 5,339,971 | A | | 8/1994 | Rohrig | |
| 5,402,908 | A | * | 4/1995 | Warden et al. | 220/529 |
| 5,431,290 | A | | 7/1995 | Vinciguerra | |
| 5,433,353 | A | | 7/1995 | Flinn | |
| 5,474,193 | A | * | 12/1995 | Larsson et al. | 215/11.4 |
| 5,499,729 | A | | 3/1996 | Greenwood et al. | |
| 5,553,731 | A | * | 9/1996 | Schuyler | 220/713 |
| 5,560,513 | A | * | 10/1996 | Jarrell | 220/62.18 |
| 5,601,199 | A | | 2/1997 | Marty | |
| 5,607,074 | A | | 3/1997 | De Gennaro | |
| 5,692,627 | A | * | 12/1997 | Feng | 215/11.4 |
| 5,699,719 | A | * | 12/1997 | Lucas et al. | 215/13.1 |
| 5,699,921 | A | * | 12/1997 | Rodriguez | 215/11.5 |
| 5,791,503 | A | * | 8/1998 | Lyons | 215/11.1 |
| 5,901,867 | A | * | 5/1999 | Mattson | 215/261 |
| 6,053,342 | A | | 4/2000 | Chomik | |
| 6,082,183 | A | * | 7/2000 | Huber | 137/254 |
| 6,138,710 | A | | 10/2000 | Chomik et al. | |
| 6,209,736 | B1 | | 4/2001 | Chen et al. | |
| D445,193 | S | | 7/2001 | Manganiello et al. | |
| 6,253,935 | B1 | | 7/2001 | Fletcher | |
| 6,398,048 | B1 | * | 6/2002 | Kevorkian | 215/11.1 |
| 6,446,822 | B1 | * | 9/2002 | Meyers et al. | 215/11.5 |

FOREIGN PATENT DOCUMENTS

| | | | |
|---|---|---|---|
| GB | 1432798 | | 4/1976 |
| GB | 2238729 | A | 6/1991 |
| GB | 2318573 | A | 4/1998 |
| JP | 10-127734 | | 5/1998 |
| WO | WO90/07320 | | 12/1989 |

* cited by examiner

VENT DISC WITH CENTER KNOB

RELATED APPLICATION

This application claims priority in copending U.S. Design Application Ser. No. 29/121,308, filed Apr. 5, 2000.

BACKGROUND OF THE INVENTION

1. Field of the Invention

The present invention relates to vent discs that alleviate the vacuum created in containers, such as infant feeding bottles, during feeding. More particularly, the present invention relates to a member that positions a vent disc in an end of a container.

2. Description of the Prior Art

Baby feeding bottles having venting means designed to allow air to flow into the bottle to alleviate the vacuum created in the bottle during feeding, are known. Among these, bottles having bottom-mounted perforated elastomeric diaphragms, or vent discs, have proven to be effective at alleviating the vacuum, while preventing leakage. However, in order to prevent leakage while effectively alleviating the vacuum, the vent discs require a proper, snug fit within the end of the bottles or containers. This creates difficulty in positioning the vent discs both into and out of the end of the bottles or containers.

SUMMARY OF THE INVENTION

It is an object of the present invention to provide a member extending from a vent disc for positioning of the vent disc in an end of a container.

This and other objects and advantages of the present invention are achieved by a member that positions a vent disc in an end of a container comprising at least one projection extending from a center portion of the vent disc solely for positioning said vent disc in the end of the container.

DESCRIPTION OF THE INVENTION

Figure 1:
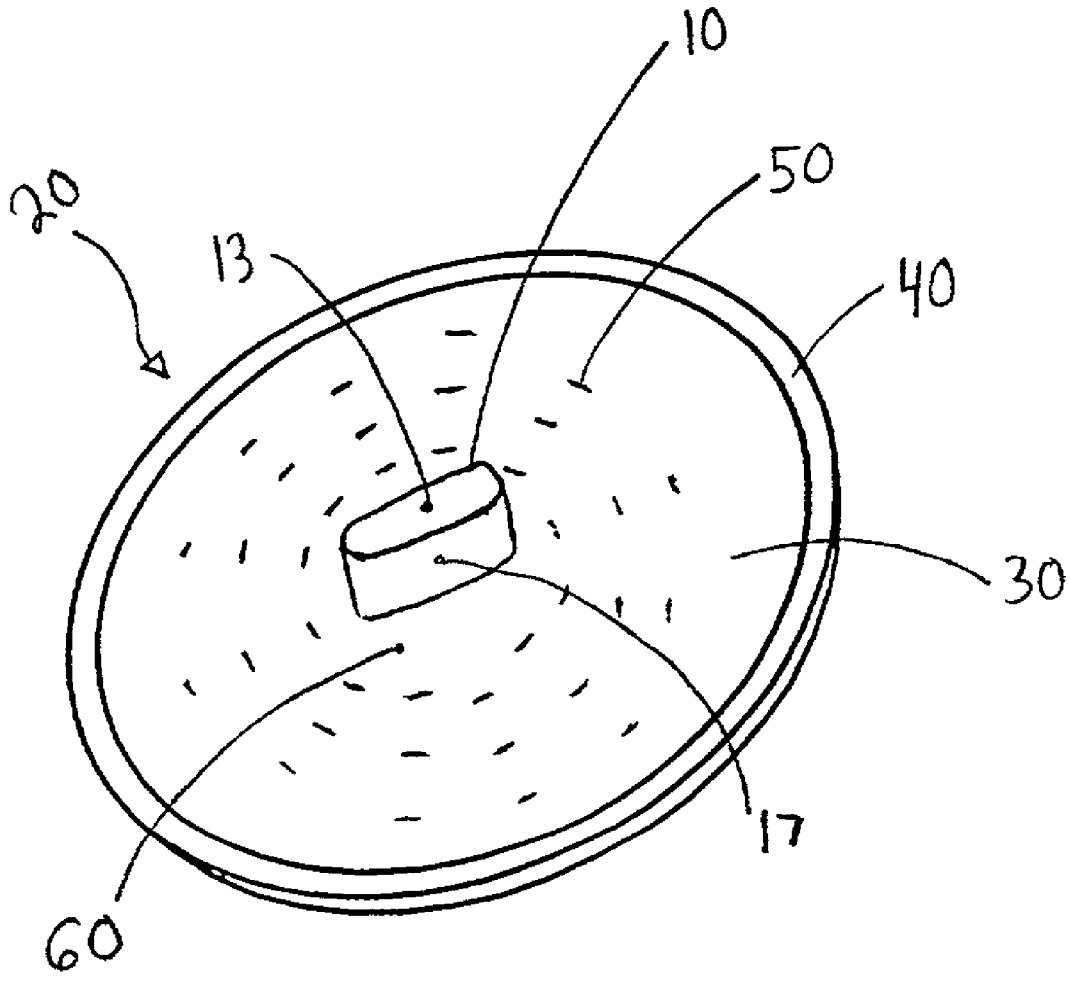
FIG. 1 is a top perspective view of a vent disc with a first embodiment of the positioning member.

Referring to the drawings and, in particular, FIGS. 1 to 6, there is shown a preferred embodiment of a vent disc of the present invention generally represented by reference numeral 20. Vent disc 20 has a member 10 for positioning a vent disc in an end 100 of a container 130. Member 10 extends from a vent disc 20.

Figure 3:
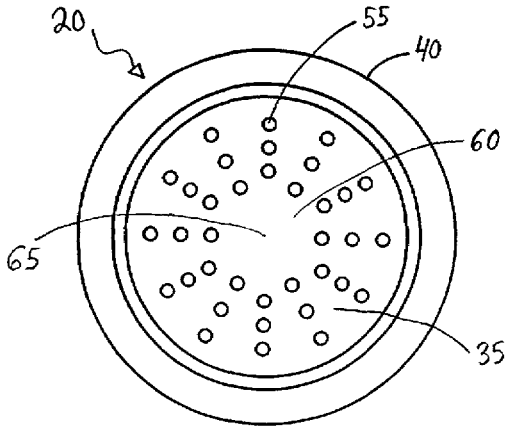
FIG. 3 is a bottom view of the vent disc of FIG. 1.

Vent disc 20 preferably has a curved dome inner portion 30 and an edge or rim 40. The inner portion 30 is preferably convexly curved in the upward direction. Inner portion 30 of vent disc 20 has a plurality of resealable elongated slits 50 therein. Slits 50 extend along radii that form the convex curvature of inner portion 30. The slits 50 are positioned on the inner portion 30 so as to provide a center area 60 of the inner portion 30 that does not have slits 50. Referring to FIG. 3, under and aligned with each slit 50, there is preferably provided a depression 55 formed into the undersurface of the inner portion 30, that controls air flow through the slit, and into the bottle or container 130 when a partial vacuum is created therein during feeding.

Member 10 extends from center portion 60 of vent disc 20. Member 10 is preferably essentially rectangular in shape but may be ellipsoidal, cylindrical or any other geometric shape that facilitates gripping or the holding of member 10. Member 10 may also have a groove or recess in its vertical extant or a lip at its uppermost edge portion that further facilitates gripping. Member 10 is preferably approximately perpendicular with the plane in which vent disc 20 is positioned but may extend from vent disc 20 at an angle that facilitates gripping or the holding of member 10.

Figure 4:
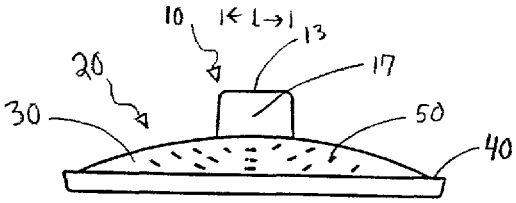
FIG. 4 is a front view of the vent disc of FIG. 1, the rear view being identical thereof.
Figure 5:
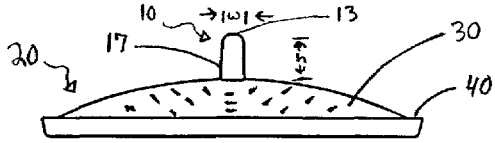
FIG. 5 is a side view of the vent disc of FIG. 1, the opposite side view being identical thereof.

As shown in FIGS. 4 and 5, in this preferred positioning member 10, the rectangular shape of member 10 has a top surface 13 with a width w of about 0.10 inches and a length l of about 0.35 inches, and a side surface 17 with a height of about 0.22 inches. However, the width w, length l, and height h of member 10 may be an alternative dimension that facilitates gripping or the holding of member 10. If the diameter of vent disc 20 increases, preferably width w, length l, and height h of member 10 will increase to further facilitate gripping or the holding of the member.

Figure 6:
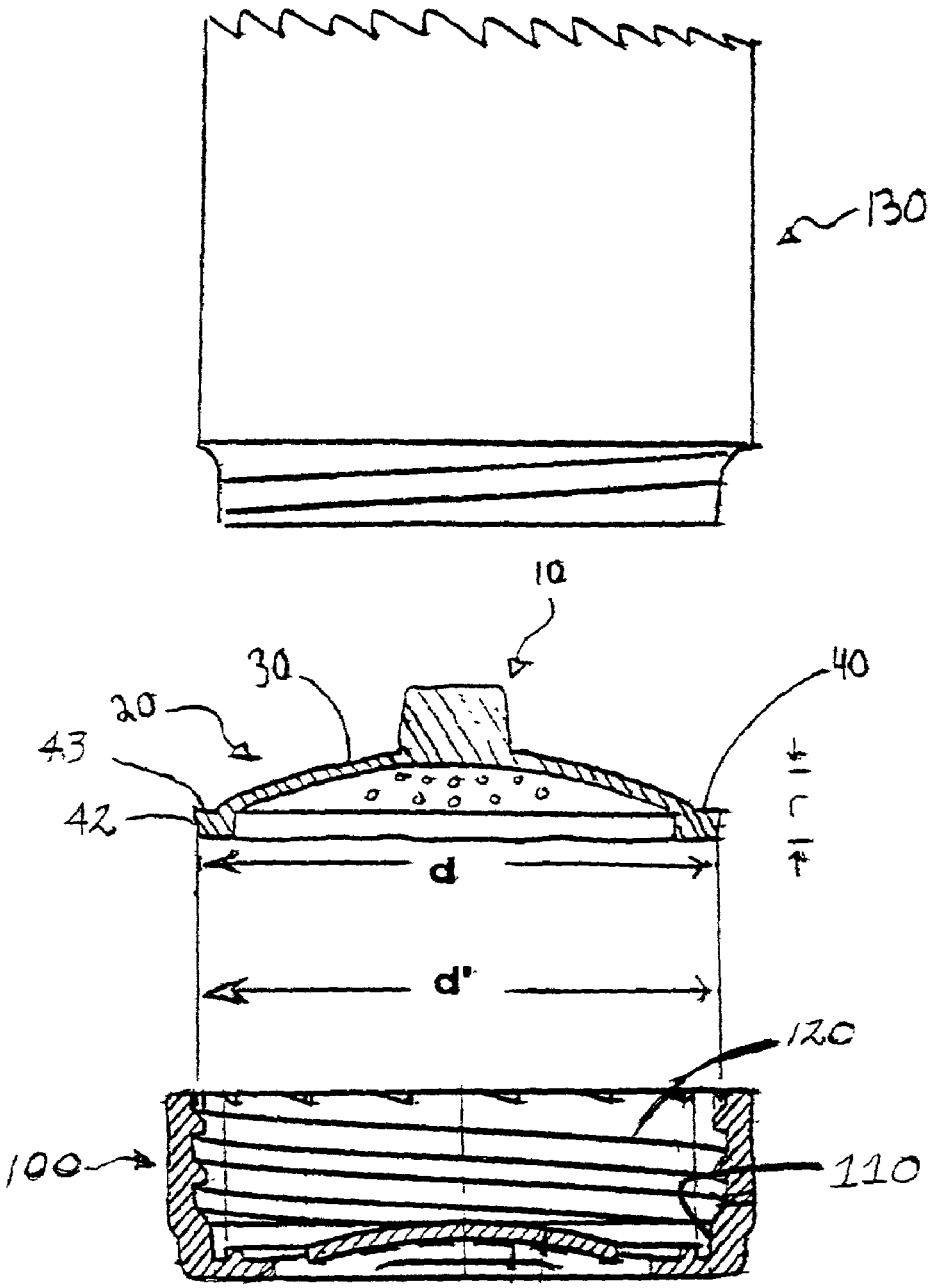
FIG. 6 is a cross-sectional view of the vent disc of FIG. 1, taken along line 6—6 of FIG. 2 with a cross section of an end cap.

Referring to FIG. 6, member 10 is solely or virtually solely for positioning vent disc 20 within the end of container 100. Member 10 is located within the center portion 60 of vent disc 20 so as not to obstruct any slit 50 or depression 55 that permits air to flow into the bottle or container. Member 10 does not have an aperture or hole that would make the member have a slit that would permit air to flow through it into the bottle or container.

Member 10 can be made of any suitable polymeric or thermoset material, such as thermoplastics, elastomers, thermoset rubbers, silicones, and the like. Combinations of these materials may also be used. Preferably, member 10 is made of thermoset rubber, most preferably a silicone. The material of member 10 can have a hardness of from about 40 to about 80 durometers. Preferably, its hardness is about 70 durometers. Preferably, member 10 can be formed integrally with vent disc 20 through a variety of methods including conventional molding and preferably a liquid injection molding technique. However, member 10 may alternatively be a member that is not integral with vent disc 20 and is fastened to vent disc 20 through a variety of means, including adhesive.

Preferably, vent disc 20 is adapted to be positioned in end cap 100 or end of container 130 by interference fit. The interference fit is formed between rim 40 of vent disc 20, preferably edges 42, and inner diameter 110 of end cap 100 or end of container 130. Also, the fit could be a snap fit. Still further, vent disc 20 may be secured into position in end cap 100 or the end of container 130 by other means including vent disc 20 being inserted into threads 120 on end cap 100 or the end of container 130. In the preferred embodiment, diameter d of rim 40 of vent disc 20 is the smallest external diameter of the rim. Diameter d is approximately equal to inner diameter d' of end cap 100 or end of container 130. The chamfered edges 42 of rim 40 provide the rim with a second larger diameter 43. The flexibility of vent disc 20 permits rim 40 to be manipulated on or under threads 120 whereby rim 40 is secured in position on or under threads. As shown in FIG. 6, a preferred embodiment of the present invention is an interference fit between the outside diameter of rim 40 of vent disc 20 and the inside diameter of end cap 100.

Figure 2:
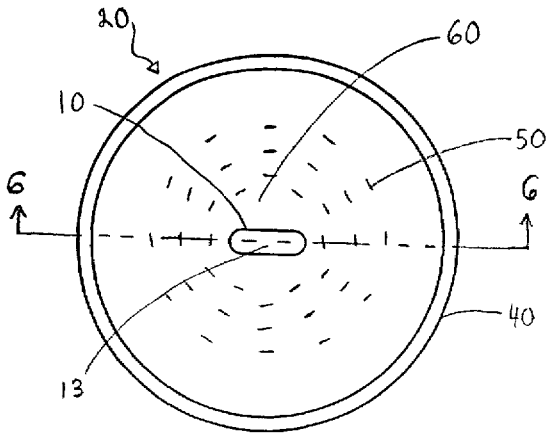
FIG. 2 is a top view of the vent disc of FIG. 1.

As shown in FIG. 6, vent disc 20 has rim 40 surrounding inner portion 30 with a planar upper surface 410 and a planar lower surface 420. End cap 100 has a peripheral portion 1010 surrounding a center portion 1020. Peripheral portion 1010 has a planar upper portion 1015 and a raised portion or circumferential ridge 1017. Center portion 1020 has an upwardly curved dome shape. Container 130 has a lower neck 1310 with threads 1320 and a planar lower rim 1330. Lower neck 1310 has a reduced diameter compared to container 130 so that a contiguous outer surface is formed along the container and end cap 100 when assembled. When vent disc 20 is positioned in end cap 100, a portion of planar lower surface 420 of vent disc 20 is disposed adjacent to a portion of planar upper portion 1015 of end cap 100. When vent disc 20 is positioned in end cap 100, curved dome inner portion 30 of vent disc 20 is substantially concentrically aligned with center portion 1020 of end cap 100. When end cap 100 is assembled with vent disc 20 and container 130, threads 1320 on the container mate with threads 120 on the end cap. When end cap 100 is assembled with vent disc 20 and container 130, planar lower rim 1330 on the container is substantially aligned with planar upper surface 410 of vent disc 20. The assembly of vent disc 20, end cap 100 and container 130 provides for engagement of the planar surfaces along lower rim 1330, upper surface 410, lower surface 420 and upper portion 1015. Apertures 50 are arranged in a circular pattern along the vent disc 20 and the circular pattern is concentrically aligned with the vent disc and center area 60, as shown in FIGS. 1 and 2.

Member 10 extends from center portion 60 of vent disc 20 so that when member 10 is pulled in a direction away from end cap 100 or end of container 130, the radial length r of central panel 30 increases to permit the removal of the vent disc from its interference fit position. Thus, when vent disc 20 is pulled in the removal direction, the force of removal will overcome the friction of the interference fit and, thus, permit removal of the vent disc.

FIGS. 1 to 6 refer to the preferred embodiment of the member comprising one member 10 that is a projection extending from vent disc 20. Alternatively, the positioning member 10 may be a plurality of projections that facilitate gripping or the holding of projection 10.

Figure 7:
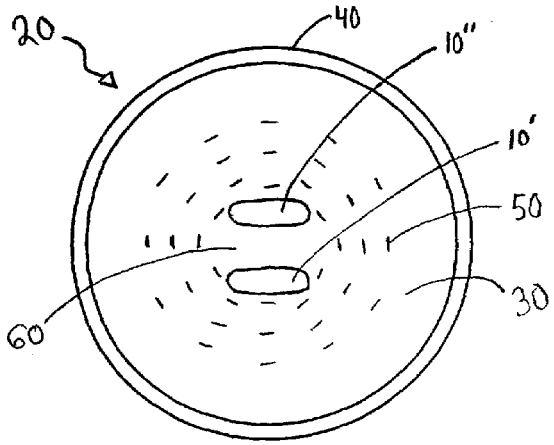
FIG. 7 is a top view of an alternative embodiment of a vent disc with a second embodiment of a positioning member of the present invention.
Figure 8:
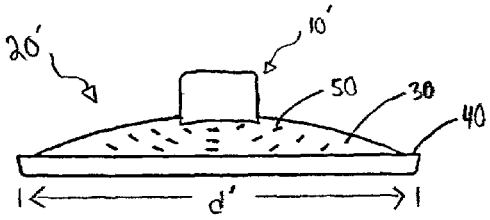
FIG. 8 is a front view of the vent disc of FIG. 7, the rear view being identical thereof.
Figure 9:
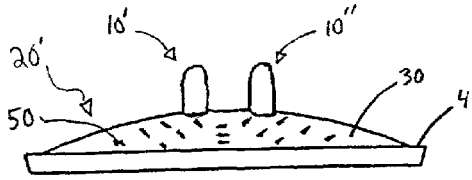
FIG. 9 is a side view of the vent disc of FIG. 7, the opposite side view being identical thereof.

In FIGS. 7 to 9, there is shown an alternative embodiment of the positioning member that is two projections generally represented by reference numerals 10' and 10", respectively. Projections 10' and 10" extend from a center portion 60' of vent disc 20' and are solely for positioning vent disc 20' in the end of a container. Projections 10' and 10" do not have perforations that would permit air to flow through them into the bottle or container. When projections 10' and 10" are pulled in a direction away from the end of the container, the diameter d' of vent disc 20' decreases. This reduction in diameter d' permits the removal of vent disc 20' from its interference fit position in the end of the container. It is understood that alternatively, but less preferably, a snap fit instead of interference fit can be used.

The present invention having thus been described with particular reference to the preferred forms thereof, it will be obvious that various changes and modifications may be made therein without departing from the spirit and scope of the present invention as defined in the appended claims.

What is claimed is:

1. A container assembly comprising:

a container having an inner volume and top and bottom ends that are open, said top end being adapted for feeding;

an end cap removably connected to said bottom end and having a center portion with an upper face; and a vent disc removably positioned in said end cap, said vent disc having an inner portion, a projection and an aperture, said inner portion having an upper surface and a lower surface, said lower surface being disposed substantially adjacent to said upper face of said end cap when said vent disc is positioned in said end cap, said projection extending from said upper surface of said inner portion, said aperture being disposed through said inner portion, wherein said projection extends a length and in a direction in relation to said vent disc and said end cap thereby being accessible and manipulatable when said vent disc is removably positioned in said end cap, wherein the container assembly permits flow into said inner volume through said aperture when a vacuum develops in said inner volume, wherein the container assembly substantially prevents flow out of said inner volume through said aperture, wherein said projection extends towards said top end, wherein said aperture is a plurality of apertures, wherein said center portion of said end cap has a plurality of holes disposed therethrough, and wherein the container assembly permits flow into said inner volume through said plurality of apertures and said plurality of holes when a vacuum develops in said inner volume.

2. The container assembly of claim 1, wherein said vent disc has a rim surrounding said inner portion, wherein said end cap has a peripheral portion surrounding said center portion, wherein said container has a neck, and wherein said rim of said vent disc is held between said neck and said peripheral portion of said end cap when said vent disc, said end cap and said container are assembled.

3. The container assembly of claim 1, wherein said aperture through said vent disc is an elongated slit.

4. The container assembly of claim 1, wherein said aperture through said vent disc is a plurality of apertures, and wherein said plurality of apertures are arranged in a substantially circular pattern along said vent disc.

5. The container assembly of claim 4, wherein said substantially circular pattern of said plurality of apertures is concentrically aligned with said vent disc.

6. A container assembly comprising:

a container having top and bottom ends that are open, said top end being adapted for feeding;

an end cap removably connected to said bottom end of said container and having a center portion with a hole; and a vent disc being removably positioned in said end cap, said vent disc having a plurality of projections, a resealable aperture, and an inner portion with a center area, wherein said plurality of projections extend from said inner portion towards said first open end and at least substantially traverse said center area, wherein said aperture is disposed through said inner portion, and wherein said resealable aperture vents said container.

7. The container assembly of claim 6, wherein said plurality of projections extend a length and in a direction in relation to said vent disc and said end cap thereby being accessible and manipulatable when said vent disc is removably positioned in said end cap, wherein said aperture is a plurality of apertures, and wherein said hole is a plurality of holes.

8. The container assembly of claim 6, wherein said vent disc has a rim surrounding said inner portion, wherein said end cap has a peripheral portion surrounding said center portion, wherein said container has a neck, and wherein said rim of said vent disc is held between said neck and said peripheral portion of said end cap when said vent disc, said end cap and said container are assembled.

9. The container assembly of claim 8, wherein said inner portion of said vent disc has a dome-shape, and wherein said center portion of said end cap has a dome-shape.

10. The container assembly of claim 8, wherein said plurality of apertures through said vent disc are elongated slits.

11. The container assembly of claim 10, wherein said plurality of apertures through said vent disc are arranged in a substantially circular pattern along said vent disc.

12. The container assembly of claim 11, wherein said substantially circular pattern of said plurality of apertures is concentrically aligned with said center area of said vent disc.

13. A container assembly comprising:

a container having top and bottom ends that are open;

an end cap removably connected to said bottom end, said top end being adapted for feeding; and a vent disc removably disposed in said end cap and having an elastomeric inner portion, at least one projection extending from said inner portion and at least one resealable aperture disposed on said inner portion, wherein said at least one projection extends a length and in a direction in relation to said elastomeric inner portion and said end cap thereby being accessible and manipulatable when said vent disc is removably disposed in said end cap, wherein said container is vented by said at least one resealable aperture, wherein said inner portion has a curved dome shape, wherein said at least one projection extends towards said top end, and wherein said at least one resealable aperture is a plurality of elongated slits.

14. The container assembly of claim 13, wherein said inner portion has a surface, wherein a plurality of depressions are formed in said surface, and wherein each of said plurality of depressions are aligned with one of said plurality of slits.

15. The container assembly of claim 14, wherein each of said plurality of slits is formed along radii that form the curvature of said inner portion.

16. The container assembly of claim 13, wherein said vent disc has a rim surrounding said inner portion, wherein said rim has a lower surface with a planar portion, and wherein said planar portion abuts said end cap when said vent disc is assembled with said end cap and said container.

17. The container assembly of claim 16, wherein said end cap has a peripheral portion with a planar upper portion, and wherein said planar upper portion has an upper portion that is disposed adjacent to said planar portion of said lower surface of said rim when said vent disc is assembled with said end cap and said container.

18. The container assembly of claim 17, wherein said end cap has a center portion with a curved dome shape, wherein said planar upper portion of said end cap surrounds said center portion, and wherein said center portion is substantially concentrically aligned with said inner portion of said vent disc when said end cap is assembled with said container.

19. The container assembly of claim 18, wherein said end cap has a ridge about said center portion, wherein said planar upper portion of said end cap surrounds said ridge, and wherein said ridge abuts said vent disc when said end cap is assembled with said container.

20. The container assembly of claim 16, wherein said rim has an upper surface with a planar portion that abuts said container when said vent disc is assembled with said end cap and said container.

21. The container assembly of claim 20, wherein said container has a flat portion that abuts against said planar portion of said upper surface of said rim when said vent disc is assembled with said end cap and said container.

22. The container assembly of claim 13, wherein said at least one projection has a shape selected from the group consisting essentially of rectangular, ellipsoidal, and cylindrical.

23. The container assembly of claim 13, wherein said at least one projection is substantially orthogonal to said inner portion.

24. The container assembly of claim 13, wherein said at least one projection is made from a material selected from the group consisting essentially of polymeric, thermoset, and any combination thereof.

25. The container assembly of claim 24, wherein said material is selected from the group consisting essentially of a thermoplastic, elastomer, thermoset rubber, silicone, and any combinations thereof.

26. The container assembly of claim 13, wherein said at least one projection is integrally molded with said inner portion.

27. The container assembly of claim 13, wherein said at least one projection has a hardness of about 70 durometers.

28. The container assembly of claim 13, wherein said inner portion has a center portion, and wherein said at least one projection is at least partially disposed along said center portion.

29. The container assembly of claim 13, wherein said bottom end has a lower neck with a first securing structure, wherein said end cap has a second securing structure, and wherein said first and second securing structures are engageable to assemble said end cap with said container.

30. The container assembly of claim 29, wherein said first and second securing structures are threads.

31. The container assembly of claim 29, wherein said lower neck has a reduced diameter compared to said container, wherein said container has a first outer surface above said lower neck, wherein said end cap has a second outer surface, and wherein said first outer surface is substantially contiguous with said second outer surface when said end cap is assembled with said container.

32. The container assembly of claim 13, wherein said end cap has a center portion with a curved dome shape, and wherein said center portion is substantially concentrically aligned with said inner portion of said vent disc when said end cap is assembled with said container.

* * * * *